United States Patent [19]

Schmid et al.

[11] Patent Number: 4,874,579

[45] Date of Patent: Oct. 17, 1989

[54] ACYLATED 3-AMINO-1,2,4-TRIAZOLES AS CORROSION INHIBITORS FOR NON-FERROUS METALS

[75] Inventors: Karl-Heinz Schmid, Mettmann; Josef Penninger, Hilden; Hinrich Moeller, Monheim, all of Fed. Rep. of Germany

[73] Assignee: Henkel Kommanditgesellschaft auf Aktien, Duesseldorf, Fed. Rep. of Germany

[21] Appl. No.: 62,294

[22] Filed: Jun. 12, 1987

[30] Foreign Application Priority Data

Jun. 13, 1986 [DE] Fed. Rep. of Germany ..... 3620025

[51] Int. Cl.[4] ..... C23F 11/04; C23F 11/00

[52] U.S. Cl. ..... 422/16; 422/7; 252/392

[58] Field of Search ..... 422/16, 7; 252/392, 252/394

[56] References Cited

U.S. PATENT DOCUMENTS 4,283 296 8/1981 Nebzydoski et al. ..... 252/49.9
4,298,568 11/1981 Gerhardt et al. ..... 422/16

FOREIGN PATENT DOCUMENTS 2094776 9/1982 United Kingdom .
25863 4/1981 European Pat. Off. .
3519522 4/1986 Fed. Rep. of Germany .

OTHER PUBLICATIONS

Chemical Abstracts 78:113645t.
Chemical Abstracts 98:372326.
The Merck Index, 9th Edition, p. 145.
Hackh's Chemical Dictionary, 4th Edition, p. 91.
Chemical Abstracts 84:051657/09.
Chemical Abstracts 100:214279e.
"Angewandte Chemie" 75, (1963), No. 23, pp. 1157–1175.

*Primary Examiner*—Kenneth M. Schor
*Attorney, Agent, or Firm*—Ernest G. Szoke; Wayne C. Jaeschke; Daniel S. Ortiz

[57] ABSTRACT

3-acylamino-1,2,4-triazoles corresponding to the following general formula

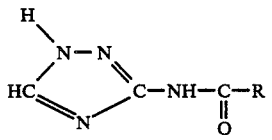

(I)

and 1-acyl-3-amino-1,2,4-triazole corresponding to the general formula

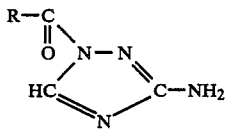

(II)

in which R is a linear or branched $C_{1-11}$ alkyl or phenyl, and mixtures thereof are used as corrosion inhibitors for non-ferrous metals in aqueous systems, oils and oil-containing emulsions.

11 Claims, No Drawings

ACYLATED 3-AMINO-1,2,4-TRIAZOLES AS CORROSION INHIBITORS FOR NON-FERROUS METALS

BACKGROUND OF THE INVENTION

1. Field of the Invention

This invention relates to the use of 3-acylamino-1,2,4-triazoles and 1-acyl-3-amino-1,2,4-triazoles and mixtures thereof as corrosion inhibitors for non-ferrous metals in aqueous systems, oils and oil-containing emulsions.

2. Statement of Related Art

By virtue of their relatively high corrosion resistance, non-ferrous metals, for example copper or zinc, or alloys containing them, such as brass or bronze, are preferentially used as industrial materials. The surfaces of metals such as these are corroded in industrial processes where they come into contact with oils or oil-containing aqueous emulsions, in some cases under extreme temperature and pressure conditions. Examples of such processes are industrial cooling processes, surface cleaning processes for metals and processes for machining metal surfaces, such as drilling, cutting, rolling, etc. Although oils or oilcontaining emulsions are used in processes such as these, the effect of water on the metal surface cannot be completely avoided. Moreover, the successive corrosion of the metal parts coming into contact with the oils or oil-containing liquids distinctly shortens the useful life of the machines involved and leads to problems in the subsequent treatment of the metal surface.

In addition, non-ferrous metals of the type in question are preferentially used in the construction of water-carrying installations, such as steam-generation plants, heating systems, cooling water circuits, and the like. They are of particular significance as condenser-tube materials in steam-powered electricity generating stations. However, despite their relatively high resistance to corrosion, analytically detectable quantities of the high-quality materials, particularly copper, are unavoidably leached by the water flowing through under normal conditions. Traces of copper in particular accumulate on subsequent cooling water pipes of steel or other less noble metals or metal alloys where they lead to - in some cases disastrous - pitting corrosion.

For this reason, additional treatment of the water coming into contact with the non-ferrous metals to reduce this erosion of metal is of technical importance. In practice, there are very few inhibitors suitable for this purpose; these inhibitors are essentially mercaptobenzthiazole, benzotriazole, tolyl triazole, and benzimidazole. These compounds are relatively effective as copper inhibitors but are attended by numerous disadvantages. Thus, in chemical terms, they are relatively difficult to obtain and, because of this, can only be used to a limited extent on economic grounds. Another disadvantage of the compounds mentioned is their very poor solubility at acidic pH-values, with the result that considerable difficulties are involved in the blending of these products, particularly in concentrate form, for practical application. In addition, these concentrates are generally not sufficiently stable in storage. Another disadvantage is that, in some cases, the compounds mentioned and their derivatives are highly toxic and, accordingly, are prohibited in certain fields of application.

U.S. Pat. No. 4,298,568 (corresponding to published German patent application 29 34 461) as well as published European patent application 25,863 describe the use of 3-amino-5-alkyl-1,2,4-triazoles to inhibit the corrosion of non-ferrous metals in aqueous raw-water systems. These compounds certainly show better performance properties than the above-mentioned corrosion inhibitors and, in addition, are relatively easy to obtain.

However, a crucial disadvantage of the foregoing compounds is that they are produced from a carboxylic acid by reaction with aminoguanidinium hydrogen carbonate in a condensation reaction which can only be catalyzed with hydrochloric acid. The use of any other mineral acid, for example phosphoric acid, results in poor yields of alkylaminotriazole. Since the hydrochloric acid used as catalyst is known to have a highly corrosive effect upon the equipment and reaction vessels used, the condensation reaction can only be carried out in specially protected vessels or using suitable apparatus, such as enamel reactors, enamel-lined cooling systems, etc., which are difficult or in some instances impossible to obtain and which involves considerable effort and expense. For efficiency as well as economy, therefore, a search has been conducted for other, more safe and less expensive readily obtainable compounds which may be used as corrosive inhibitors for non-ferrous metals.

German patent application 35 19 522 (published Dec. 4, 1986, subsequent to the German priority application of the present invention) describes the use of 1,2,4-triazole derivatives in which the alkyl moiety in the 5-position of the heterocyclic ring is terminally hydroxylated. The disadvantages of previously known triazole derivatives, such as their poor solubility in water at acidic pH-values, are eliminated in this way. Unfortunately, the corrosion-inhibiting effect of compounds such as these falls far short of requirements.

DESCRIPTION OF THE INVENTION

Other than in the operating examples, or where otherwise indicated, all numbers expressing quantities of ingredients or reaction conditions used herein are to be understood as modified in all instances by the term "about".

The present invention provides chemically readily obtainable corrosion inhibitors for non-ferrous metals which not only show favorable properties in terms of practical application, but also develop a good corrosion-inhibiting effect in aqueous solutions, oils and oil-containing emulsions, even in low concentrations, and which in addition may readily be blended in concentrate form and may be stored for prolonged periods without any loss of activity.

It has now surprisingly been found that acyl-substituted 3-amino-1,2,4-triazoles have a good corrosion-inhibiting effect for non-ferrous metals both in aqueous systems and in oils and oil-containing emulsions and, at the same time, also show excellent properties in terms of practical application.

The present invention affords corrosion inhibitors for non-ferrous metals in aqueous systems, oils and oil-containing emulsions comprising corrosion inhibition effective amounts of at least one 3-acylamino-1,2,4-triazole corresponding to the formula

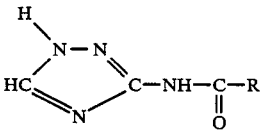

(I)

and/or of at least one 1-acyl-3-amino-1,2,4-triazole corresponding to the formula

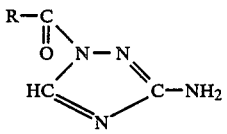

(II)

in which R is a linear or branched $C_{1-11}$ alkyl or a phenyl, as well as methods for their use.

Compounds corresponding to general formulae (I) and (II) are known per se. Any 3-acylamino-1,2,4-triazoles and 1-acyl-3-amino-1,2,4-triazoles, of which the amino group attached to the C-atom in the 3-position of the heterocyclic ring and of which the N-atom in the 1-position of the heterocylcic ring are substituted by an acyl radical corresponding to the general formula R-CO-, where R is a linear or branched $C_{1-11}$ alkyl or phenyl, are suitable for use as corrosion inhibitors in accordance with the invention. Accordingly, suitable 3-amino-1,2,4-triazole derivatives corresponding to general formulae (I) and (II) include those compounds - or mixtures thereof - which, at the free amino moiety or at the N-atom in the 1-position have at least one radical which is acetyl, propionyl, n-butyryl, n-pentanoyl, n-hexanoyl, n-heptanoyl, n-octanoyl, n-nonanoyl, n-decanoyl, n-undecanoyl, n-dodecanoyl or benzoyl or corresponding branched radicals, such as sec.-butyryl, 2-ethylhexanoyl or the like. Benzoyl and n-octanoyl are preferred.

Accordingly, those compounds corresponding to general formulae (I) and (II), in which the substituent R is phenyl or n-heptyl, or mixtures thereof are particularly suitable for the purposes of the invention. In other words, the compounds mentioned below and mixtures thereof are particularly suitable for use in accordance with the invention as highly effective corrosion inhibitors for non-ferrous metals:

3-benzoylamino-1,2,4-triazole
1-benzoyl-3-amino-1,2,4-triazole
3-n-octanoylamino-1,2,4-triazole
1-n-octanoyl-3-amino-1,2,4-triazole.

The 3-acylamino-1,2,4-triazoles (I) and 1-acyl-3-amino-1,2,4-triazoles (II) used in accordance with the invention are produced by known methods. Thus, the 1,2,4-triazole amino-substituted in the 3-position of the heterocyclic ring may be prepared by reaction of formic acid with aminoguanidinium hydrogen carbonate. The production process is described in "Angewandte Chemie" 75, 1160 (1963). The compounds corresponding to general formulae (I) and (II) used in accordance with the invention are obtained from the resulting 3-amino-1,2,4-triazole (III) by reaction with the corresponding acid chlorides or methyl esters corresponding to the general formula R—CO—X, where R is as defined above and X represents Cl or $OCH_3$. The reaction may take place in accordance with the following scheme:

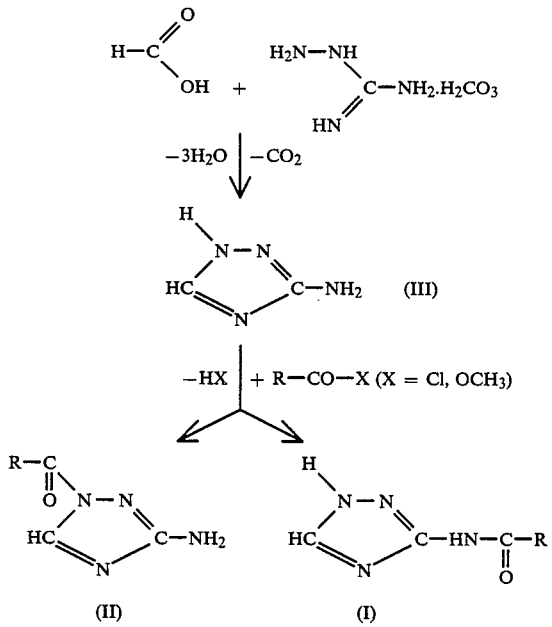

If this acylation reaction is carried out at temperatures of around 70° C., a mixture of compounds (I) and (II) in a weight ratio of approximately 1:1 is formed. This mixture may contain compounds (I) and (II) in a ratio of 1:.67-1.5, depending on the reaction temperature and the acylating reagent used. If, by contrast, the reaction is carried out at a temperature around room temperature, compound (II), i.e. a 1-acyl-3-amino-1,2,4-triazole, is almost exclusively formed. On the other hand, compound (II) is rearranged to compound (I) by heating the mixture formed to temperatures of around 200° C., so that compound (I), i.e. a 3-acylamino-1,2,4-triazole, is almost exclusively obtained in this way. Thus, it is possible either to control the composition of the mixture through the choice of the reaction temperature, or to arrive at the individual compounds by subsequent heating.

The compounds corresponding to general formulae (I) and (II) and mixtures thereof may be used as corrosion inhibitors for non-ferrous metals, more especially for copper and brass, both in aqueous systems and in oil-containing emulsions and oily systems in any field of industry, for example in drilling and cutting oils, rolling oils, wire-drawing oils, deep-drawing oils, lubricating oils, lubricating greases, hydraulic oils, transmission oils, cooling waters, raw waters, metal cleaning preparations, cleaning preparations for domestic and industrial purposes, and the like.

In view of these various fields of application and the various formulations used therein, the particular quantity in which the corrosion inhibitor according to the invention is used may vary within wide limits, it being axiomatic that the quantity is always in an amount effective for corrosion inhibition. Thus, the quantity of corrosion inhibitor required for adequate corrosion inhibition in cooling water systems is preferably 0.1 to 5 $g/m^3$ whereas, in wire-drawing oils, the same quantity preferably may be at least 100 $g/m^3$ and possibly even as large as 300–400 $g/m^3$.

The 3-amino-1,2,4-triazole derivatives of general formulae (I) and (II) used in accordance with the invention have the advantage over previously known corrosion inhibitors for non-ferrous metals that they can be obtained in high yields from inexpensively obtainable starting materials by chemically simple methods and may be produced using inexpensive apparatus.

However, particular emphasis is placed on their excellent corrosion-inhibiting effect in aqueous systems and in oil-containing systems, for example drilling and cutting oils, which contain sulfur compounds, for example sulfurized animal oil or sulfurized olefins, and which are known in industry as "high-pressure additives". In this regard see Example 3 and Table 2, infra.

The invention is illustrated by the following Examples.

EXAMPLE 1

Preparation of the 3-acylamino- and 1-acyl-3-amino-1,2,4-triazoles 0.5 mil of the desired carboxylic acid chloride was added in 20 mins. at 20° C. to 0.5 mol of the 3-amino-1,2,4-triazole prepared from formic acid and the hydrogen carbonate of aminoguanidine and 0.5 mol pyridine in 750 ml acetonitrile. The reaction mixture was stirred for 1.5 h at 70° C. The white deposit formed was then filtered off, washed with chloroform and dried. The yield was in the range of 60 to 95%, depending on the reactants used. A mixture of the corresponding 3-acylaminoand 1-acyl-3-amino-1,2,4-triazoles is obtained in this way, containing the 3-acylamino-1,2,4-triazole and the 1-acyl-3-amino1,2,4-triazole in a ratio of 1:.67-1.5, depending on the particular carboxylic acid chloride used.

EXAMPLE 2

The corrosion-inhibiting properties were determined by the following test:

5 parts of the concentrate described below were mixed with 95 parts water (hardness: 20°Gh.). The concentrate had the following composition:

2.0% rapeseed oil fatty acid
15.0% oleic acid polydiethanolamide
5.0% coconut oil fatty acid polydiethanolamide
35.0% trimethylol propane tricaprylate
30.0% castor oil +11 mols ethylene oxide
6.0% butyl glycol
6.4% deionized water
0.6% corrosion inhibitor The following substances according to this invention were used as corrosion inhibitors in the concentrate:

(A) a mixture of 3-n-octanoylamino- and 1-n-octanoyl-3-amino-1,2,4-triazole
(B) a mixture of 3-acetylamino- and 1-acetyl-3-amino-1,2,4-triazole
(C) a mixture of 3-benzoylamino- and 1-benzoyl-3-amino-1,2,4-triazole.

All the substances were completely soluble in the concentrate.

A 75 mm×12 mm×1.5 mm test plate of copper, which had been carefully rubbed with sandpaper and cleaned with acetone, was stored for 4 weeks at 20° C. in each of the aqueous solutions thus prepared accommodated in a glass beaker. Thereafter, the copper test plate was inspected for discoloration and loss of brightness, in addition to which the concentration of the copper ions contained in the aqueous solutions was determined. To this end, the water lost through evaporation was replaced in each case. Since, in addition, emulsions are adversely affected by metal ions, the quality of the emulsions was also evaluated.

Evaluations of the copper test plates was based on the following criteria using a scale of 0 to 6 in which:

| | |
|---|---|
| 0 = no change | |
| 1 = slightly tarnished, narrow streak | (cannot be washed off) |
| 2 = slightly tarnished, broader streak | (cannot be washed off) |
| 3 = tarnished | (cannot be washed off) |
| 4 = surface slightly corroded | (cannot be washed off) |
| 5 = surface corroded | (cannot be washed off) |
| 6 = surface heavily corroded | (cannot be washed off) |

The test results are set out in Table 1 below in which the evaluation of the copper plates and the indication of the quantity of copper ions in the solution after the test are based on the 5% aqueous solutions containing the particular corrosion inhibitor.

TABLE 1

| Concentrate containing substance . . . | Appearance of Emulsion | Appearance of Copper plate | Copper ions (ppm) |
|---|---|---|---|
| A | Coarse | 1 | 5 |
| B | Precipitation | 1 | 5 |
| C | Fine | 0 | 3 |
| Comp. Ex. 1 Blank value | Fine | 1 | 3 |
| Comp. Ex. 2 | Fine | 4 | 10 |

As can be seen from Table 1, excellent corrosion inhibition values can be obtained on copper plates with compounds corresponding to general formulae (I) and (II), more especially with 3-benzoylamino- and 1-benzoyl-3-amino-1,2,4-triazole (C).

COMPARISON EXAMPLE 1

The corrosion inhibition test described in Example 2 was carried out using the corrosion inhibitor known from U.S. Pat. No. 4,298,568. 3-Amino-5-(heptyl-/nonyl-)1,2,4-triazole was used as comparison inhibitor. The result is shown above in Table 1. Although the test results are acceptable, this compound presents the difficulties discussed above in the "Statement of Related Art."

COMPARISON EXAMPLE 2

The corrosion inhibition test described in Example 2 was also carried out in the absence of corrosion inhibitors for non-ferrous metals. Instead of the corrosion inhibitor (0.6%), water was added to the concentrate in the same quantity. The result is shown above in Table 1.

EXAMPLE 3

The corrosion inhibition test described in Example 2 was carried out with a concentrate having the following composition:

5.0% trimethylolpropane tricaprylate
10.0% petroleum sulfonate, barium salt
6.0% tetrapropylene sulfide containing 32% sulfur
6.0% glycerol trioleate
10.0% tall oil fatty acid
3.0% triethanolamine
2.3% potassium hydroxide solution, 45%
48.2% naphthenic mineral oil 2.5% propylene glycol (mol. weight 420)
2.0% nonyl phenol containing 6.5 mols ethylene oxide
4.4% deionized water
0.6% corrosion inhibitor.

Compounds (A) to (C) according to this invention and as mentioned in Example 2 were again used as corrosion inhibitors. The results are shown below in Table 2 in which the evaluation of the copper plates and the indication of the quantity of copper ions in the aqueous solution are based on the 5% aqueous solutions. A lower amount of copper ions is, of course, preferable since it shows less corrosion and therefore greater corrosion inhibition.

TABLE 2

| Concentrate containing substance . . . | Appearance of Emulsion | Appearance of Copper plate | Copper ions (ppm) |
|---|---|---|---|
| A | Oil separation Green coloration | 6 | 30 |
| B | Oil separation Green coloration | 5 | 100 |
| C | Very slight oil separation fine, colorless emulsion | 1 | 15 |
| Comp. Ex. 3 | Oil separation Green coloration | 5 | 100 |
| Blank value Comp. Ex. 4 | Oil separation Green coloration | 4 | 300 |

Result:

In this system, too, excellent corrosion inhibition can be obtained with the compounds of general formulae (I) and (II) used in accordance with the invention, more especially with 3-benzoylaminoand 1-benzoyl-3-amino-1,2,4-triazole. It is emphasized that the concentrate (i.e. corrosive substance plus corrosion inhibitor) used in this example contains sulfur, which creates special corrosive effects and which is discussed supra. It was found that the benzoyl derivatives in particular (i.e. substances A and C of Example 2) are distinctly superior to the other corrosion inhibitors for non-ferrous metals known from the prior art, and therefore are preferred embodiments of this invention.

COMPARISON EXAMPLE 3

The corrosion test described in Example 2 was carried out with the concentrate formulation described in Example 3 using as corrosion inhibitor the 3-amino-5-(heptyl-/nonyl-)1,2,4-triazole known for this purpose from U.S. Pat. No. 4,298,568. The result is shown above in Table 2. Although the test results are acceptable, this compound presents the difficulties discussed above in the "Statement of Related Art".

COMPARISON EXAMPLE 4

The corrosion test described in Example 2 was carried out with the concentrate described in Example 3, but without a corrosion inhibitor. Instead of the corrosion inhibitor (0.6%), water was added to the concentrate. The result is shown above in Table 2.

EXAMPLE 4

Material: electrolytic copper

Three carefully pretreated and weighed metal strips measuring 80×15×1 mm were suspended in a 1-liter vessel containing 800 ml test water and a defined quantity of compounds corresponding to general formula (I) and left therein for 24 h. The solution was stirred at a speed of 80 r.p.m.-1.

The test water used as corrosive medium was prepared in accordance with DIN (German Industrial Norm) 51,360/2 and was buffered to pH 9.0 with ammonia/ammonium chloride. After the test period, the metal strips were dried and weighed. The corrosion inhibition value I, based on a blank sample, was calculated from the weight loss in accordance with the following equation:

$$I = 100\,(1 - a/b)$$

In this equation, a represents the weight loss of the test sample and b the weight loss of the blank sample.

Compounds (B) and (C) as mentioned in Example 2 were again used as corrosion inhibitors. The results of the erosion test are shown in Table 3 below.

TABLE 3

| Concentrate containing substance . . . | Corrosion inhibition value I at $10^{(a)}$ | $1^{(a)}$ | $0.5^{(a)}$ |
|---|---|---|---|
| B | 99 | 89 | 57 |
| C | 99 | 98 | 99 |
| Comp. Ex. 5 | 91 | 86 | 44 |

$^{(a)}$Inhibitor concentration in $g/m^{-3}$

As can be seen from Table 3, excellent corrosion inhibition values can be obtained on copper plates, even in purely aqueous media, with the compounds of general formulae (I) and (II), more especially with 3-benzoylamino- and 1-benzoyl-3-amino-1,2,4-triazole (C).

COMPARISON EXAMPLE 5

Commercially obtainable 3-amino-1,2,4-triazole was used as comparison inhibitor. The result is shown above in Table 3. It can be seen that the effect of the non-acylated 3-amino-1,2,4-triazole is considerably weaker.

EXAMPLE 5

Material: zinc (99.5%)

For the same procedure as in Example 4, the results shown in Table 4 below were obtained in the erosion test.

Compounds (A) to (C) as mentioned in Example 2 were used as the corrosion inhibitors.

TABLE 4

| Concentrate containing substance . . . | Corrosion inhibition value I at $2^{(a)}$ | $1^{(a)}$ |
|---|---|---|
| A | 98 | 92 |
| B | 64 | 37 |
| C | 88 | 52 |
| Comp. Ex. 6 | 51 | 0 |

$^{(a)}$Inhibitor concentration in $g/m^{-3}$

As can be seen from Table 4, excellent corrosion inhibition values can be obtained on zinc plates, even in purely aqueous media, with compounds corresponding to general formula (I), more especially with 3-n-octanoylamino- and 1-n-octanoyl-3-amino-1,2,4-triazole (A).

COMPARISON EXAMPLE 6

As in Comparison Example 5, 3-amino-1,2,4-triazole was used as a comparison inhibitor. The result is shown above in Table 4. It can be seen that the effect of the non-acylated 3-amino-1,2,4-triazole is considerably weaker.

The compounds of this invention are useful for inhibiting corrosion (when used in at least a corrosion-inhibiting-effective amount) in raw water, cooling water, lubricants, drilling and cutting oils, drawing oils, transmission oils, or domestic and/or industrial cleaning preparations. The method of use comprises incorporating the disclosed inventive corrosion inhibitors directly with the corrosion-causing substance.

We claim:

1. A method for corrosion inhibition for noferrous metals which contact an aqueous medium, oils and oil-containing emulsions, comprising: incorporating in said aqueous medium, oils, or oil-containing emulsions, which contact a non-ferrous metal, a corrosion-inhibition-effective amount of at least one 3-acylamino-1,2,4-triazole compound of the formula

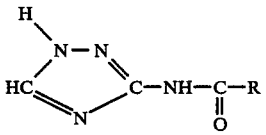

(I)

and/or at least one 1-acyl-3-amino-1,2,4 triazole compound of the formula

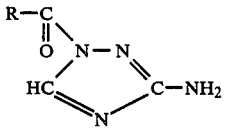

(II)

wherein R is an unsubstituted linear or branched $C_{1-11}$ alkyl, whereby corrosion of the non-ferrous metal is inhibited by the presence of said at least one triazole compound.

2. The method of claim 1 wherein compounds of both said formulas are present, in a weight ratio I:II of about 1:.67-1.5.

3. The method of claim 1 wherein compounds of both said formulas are present, in a weight ratio I:II of about 1.1.

4. The method of claim 1 wherein R is n-heptyl.

5. The method of claim 2 wherein R is n-heptyl.

6. The method of claim 3 wherein R is n-heptyl.

7. The method of claim 1 wherein said at least one compound is added in about 0.1 to 5g/m$^3$ to water in a cooling water system.

8. The method of claim 6 wherein said at least one compound is added in about 0.1 to 5g/m$^3$ to water in a cooling water system.

9. The method of claim 1 wherein said at least one compound is added in at least about 1 g/m$^3$ to a wire drawing oil.

10. The method of claim 6 wherein said at least one compound is added in at least about 100 g/m$^3$ to a wire drawing oil.

11. The method of claim 1 wherein said aqueous medium, oils, and oil-containing emulsions comprise: raw water, cooling water, lubricants, drilling and cutting oils, drawing oils, transmission oils, or domestic and/or industrial cleaning preparations.

* * * * *

UNITED STATES PATENT AND TRADEMARK OFFICE

CERTIFICATE OF CORRECTION

PATENT NO. : 4,874,579

DATED : October 17, 1989

INVENTOR(S) : Schmid et al.

It is certified that error appears in the above-identified patent and that said Letters Patent is hereby corrected as shown below:

In Claim 9, at Col. 10, line 29, "1 $g/m^3$" should read --100 $g/m^3$--.

Signed and Sealed this

Twelfth Day of February, 1991

*Attest:*

HARRY F. MANBECK, JR.

*Attesting Officer*

*Commissioner of Patents and Trademarks*